US005194220A

United States Patent [19]

Takahashi et al.

[11] Patent Number: 5,194,220

[45] Date of Patent: Mar. 16, 1993

[54] AUSTENITIC CAST STEEL AND ARTICLES MADE THEREOF

[75] Inventors: Norio Takahashi, Oomiya; Toshio Fujita, Tokyo, both of Japan

[73] Assignee: Hitachi Metals, Ltd., Japan

[21] Appl. No.: 739,023

[22] Filed: Aug. 1, 1991

[30] Foreign Application Priority Data

Aug. 2, 1990 [JP] Japan ..... 2-205461
Jul. 29, 1991 [JP] Japan ..... 3-188457

[51] Int. Cl.[5] ..... C22C 38/44

[52] U.S. Cl. ..... 420/53; 420/54; 420/55

[58] Field of Search ..... 420/57, 53, 43, 54, 420/55

[56] References Cited

U.S. PATENT DOCUMENTS 2,750,283 6/1956 Loveless ..... 420/43
2,801,916 8/1957 Harris et al. ..... 420/53

FOREIGN PATENT DOCUMENTS 297485 6/1954 European Pat. Off. .
46-16812 5/1971 Japan ..... 420/57
57-8183 12/1977 Japan .
61-87852 10/1984 Japan .
61-177352 2/1985 Japan .
669579 4/1949 United Kingdom .
675809 4/1950 United Kingdom .
746472 1/1952 United Kingdom .

*Primary Examiner*—Deborah Yee
*Attorney, Agent, or Firm*—Finnegan, Henderson, Farabow, Garrett & Dunner

[57] ABSTRACT

A heat-resistant, austenitic cast steel having a composition consisting essentially, by weight of: C: 0.15–0.60%, Si: 2.0% or less, Mn: 1.0% or less, Ni: 8.0–20.0%, Cr: 15.0–30.0%, W: 2.0–6.0%, Nb: 0.2–1.0%, B: 0.001–0.01%, and the balance being Fe and inevitable impurities is disclosed. The austenitic cast steel of the invention is ideally suited for use in exhaust equipment members.

29 Claims, No Drawings

AUSTENITIC CAST STEEL AND ARTICLES MADE THEREOF

BACKGROUND OF THE INVENTION

The present invention relates to a heat-resistant cast steel suitable for exhaust equipment members for automobiles, etc., and more particularly to a heat-resistant austenite cast steel having an excellent high-temperature strength, particularly at 900° C. or higher, and an exhaust equipment member made of such a heat-resistant cast steel.

Conventional heat-resistant cast iron and heat-resistant cast steel have compositions shown in Table 1 as Comparative Examples. In exhaust equipment members such as exhaust manifolds, turbine housings, etc. for automobiles, heat-resistant cast iron such as high-Si spheroidal graphite cast iron, NI-RESIST cast iron (Ni-Cr-Cu austenite cast iron), heat-resistant cast steel such as ferritic cast steel, etc. shown in Table 1 are employed because their operating conditions are extremely severe at high temperatures.

Further, attempts have been made to propose various heat-resistant, austenite cast steels. For instance, Japanese Patent Laid-Open No. 61-87852 discloses a heat-resistant, austenite cast steel consisting essentially of C, Si, Mn, N, Ni, Cr, V, Nb, Ti, B, W and Fe showing improved creep strength and yield strength. In addition, Japanese Patent Laid-Open No. 61-177352 discloses a heat-resistant, austenite cast steel consisting essentially of C, Si, Mn, Cr, Ni, Al, Ti, B, Nb and Fe having improved high-temperature and room-temperature properties by choosing particular oxygen content and cleaning rate. Japanese Patent Publication No. 57-8183 discloses a heat-resistant, austenite cast steel having improved high-temperature strength, without suffering from the decrease in high-temperature oxidation resistance by increasing the carbon content of the heat-resistant, austenite cast steel made of an Fe-Ni-Cr alloy and by adding Nb and Co.

Among these conventional heat-resistant cast irons and heat-resistant cast steels, for instance, the high-Si spheroidal graphite cast iron is relatively good in room-temperature strength, but it is poor in high-temperature strength and oxidation resistance. The NI-RESIST cast iron is relatively good in high-temperature strength up to 900° C., but it is poor in durability at 900° C. or higher. Also, it is expensive because of high Ni content. Heat-resistant, ferritic cast steel is extremely poor in high-temperature strength at 900° C. or higher.

Because the heat-resistant, austenite cast steel disclosed in Japanese Patent Laid-Open No. 61-87852 has a relatively low C content of 0.15 weight % or less, the resulting cast steel shows an insufficient high-temperature strength at 900° C. or higher. In addition, because it contains 0.002–0.5 weight % of Ti, harmful non-metallic inclusions may be formed by melting in the atmosphere.

In addition, because the heat-resistant, austenite cast steel disclosed in Japanese Patent Laid-Open No. 61-177352 contains a large amount of Ni, it may suffer from cracks when used in an atmosphere containing sulfur (S) at a high temperature.

Further, because the heat-resistant, austenite cast steel disclosed in Japanese Patent Publication No. 57-8183 has a high carbon (C) content, it may become brittle when operated at a high temperature for a long period of time.

OBJECT AND SUMMARY OF THE INVENTION

Accordingly, an object of the present invention is to provide a heat-resistant, austenitic cast steel having excellent high-temperature strength, which can be produced at a low cost, thereby solving the above problems inherent in the conventional heat-resistant cast iron and heat-resistant cast steel.

Another object of the present invention is to provide an exhaust equipment member made of such heat-resistant cast steel.

As a result of intense research in view of the above objects, the inventors have found that by adding proper amounts of W, Nb and B and optionally Mo and/or Co to the Ni-Cr base austenitic cast steel, the high-temperature strength of the cast steel can be improved. The present invention has been completed based upon this finding.

Thus, the heat-resistant, austenitic cast steel according to a first embodiment of the present invention has a composition consisting essentially, by weight, of:

C: 0.20–0.60%,
Si: 2.0% or less,
Mn: 1.0% or less,
Ni: 8.0–20.0%,
Cr: 15.0–30.0%,
W: 2.0–6.0%,
Nb: 0.2–1.0%,
B: 0.001–0.01%, and
the balance being Fe and inevitable impurities.

The heat-resistant, austenitic cast steel according to a second embodiment of the present invention has a composition consisting essentially, by weight, of:

C: 0.20–0.60%,
Si: 2.0% or less,
Mn: 1.0% or less,
Ni: 8.0–20.0%,
Cr: 15.0–30.0%,
W: 2.0–6.0%,
Nb: 0.2–1.0%,
B: 0.001–0.01%,
Mo: 0.2–1.0%, and
Fe and inevitable impurities: balance.

The heat-resistant, austenitic cast steel according to a third embodiment of the present invention has a composition consisting essentially, by weight, of:

C: 0.20–0.60%,
Si: 2.0% or less,
Mn: 1.0% or less,
Ni: 8.0–20.0%,
Cr: 15.0–30.0%,
W: 2.0–6.0%,
Nb: 0.2–1.0%,
B: 0.001–0.01%,
Co: 20.0% or less, and
the balance being Fe and inevitable impurities.

The heat-resistant, austenitic cast steel according to a fourth embodiment of the present invention has a composition consisting essentially, by weight, of:

C: 0.20–0.60%,
Si: 2.0% or less,
Mn: 1.0% or less,
Ni: 8.0–20.0%,
Cr: 15.0–30.0%,
W: 2.0–6.0%,
Nb: 0.2–1.0%, B: 0.001–0.01%,
Mo: 0.2–1.0%,
Co: 20.0% or less, and
the balance being Fe and inevitable impurities.

The exhaust equipment member according to the present invention is made of any one of the above heat-resistant, austenitic cast steels.

DETAILED DESCRIPTION OF THE INVENTION

The present invention will be explained in detail below.

By adding 2.0–6.0% of W, 0.2–1.0% of Nb and 0.001–0.1% of B by weight and, if necessary, proper amounts of Mo and Co alone or in combination, the resulting heat-resistant, austenitic cast steel shows an excellent high-temperature strength.

The reasons for restricting the composition range of each alloy element in the heat-resistant, austenitic cast steel of the present invention will be explained below.

In the heat-resistant, austenitic cast steel of the present invention, C, Si, Mn, Ni, Cr, W, Nb and B are indispensable alloy elements.

(1) C (carbon): 0.20–0.60%

C has a function of improving the fluidity and castability of a melt and also partly dissolves into a matrix phase, thereby exhibiting solution strengthening function. Besides, it forms primary carbides, thereby improving a high-temperature strength. To exhibit such functions effectively, the amount of C should be 0.20% or more. On the other hand, when the amount of C exceeds 0.60%, secondary carbides are excessively precipitated, leading to a poor toughness. Accordingly, the amount of C is 0.20–0.60%. The preferred amount of C is 0.20–0.50%.

(2) Si (silicon): 2.0% or less

Si is a deoxidizer and also is effective for improving oxidation resistance. However, when it is excessively added, the austenite structure of the cast steel become unstable, leading to poor high-temperature strength. Accordingly, the amount of Si should be 2.0% or less. The preferred amount of Si is 0.50–1.50%.

(3) Mn (manganese): 1.0% or less

Mn is effective like Si as a deoxidizer for the melt. However, when it is excessively added, oxidation resistance is deteriorated. Accordingly, the amount of Mn is 1.0% or less. The preferred amount of Mn is 0.30–0.80%.

(4) Ni (nickel): 8.0–20.0%

Ni is an element effective for forming and stabilizing an austenite structure of the heat-resistant cast steel of the present invention, together with Co and Cr, thereby improving high-temperature strength. Particularly, to have a good high-temperature strength at 900° C. or higher, the amount of Ni should be 8.0% or more. As the amount of Ni increases, such effects increase. However, when it exceeds 20.0%, the effects level off. This means that the amount of Ni exceeding 20.0% is economically disadvantageous. Accordingly, the amount of Ni is 8.0–20.0%. The preferred amount of Ni is 8.0–15.0%.

(5) Cr (chromium): 15.0–30.0%

Cr is an element capable of austenizing the cast steel structure when it coexists with Ni and Co, improving high-temperature strength and oxidation resistance. It also forms carbides, thereby further improving the high-temperature strength. To exhibit effectively such effects at a high temperature of 900° C. or higher, the amount of Cr should be 15.0% or more. On the other hand, when it exceeds 30.0%, secondary carbides are excessively precipitated and a brittle δ-phase, etc. are also precipitated, resulting in an extreme brittleness. Accordingly, the amount of Cr should be 15.0–30.0%. The preferred amount of Cr is 15.0–25.0%.

(6) W (tungsten): 2.0–6.0%

W has a function of improving the high-temperature strength. To exhibit such an effect effectively, the amount of W should be 2.0% or more. However, if it is excessively added, the oxidation resistance is deteriorated. Thus, the upper limit of W is 6.0%. Accordingly, the amount of W is 2.0–6.0%. The preferred amount of W is 2.0–4.0%.

(7) Nb (niobium): 0.2–1.0%

Nb forms fine carbides when combined with C, increasing the high-temperature strength. Also, by suppressing the formation of the Cr carbides, it functions to improve the oxidation resistance. For such purposes, the amount of Nb should be 0.2% or more. However, if it is excessively added, the toughness of the resulting austenitic cast steel is deteriorated. Accordingly, the upper limit of Nb is 1.0%. Therefore, the amount of Nb should be 0.2–1.0%. The preferred amount of Nb is 0.2–0.8%.

(8) B (boron): 0.001–0.01%

B has a function of strengthening the crystal grain boundaries of the cast steel and making carbides in the grain boundaries finer and further deterring the agglomeration and growth of such carbides, thereby improving the high-temperature strength and toughness of the heat-resistant, austenitic cast steel. Accordingly, the amount of B is desirably 0.001% or more. However, if it is excessively added, borides are precipitated, leading to poor high-temperature strength. Thus, the upper limit of B is 0.01%. Therefore, the amount of B is 0.001–0.01%. The preferred amount of B is 0.001–0.007%.

In the preferred embodiments, Mo and Co may be added alone or in combination together with the above indispensable elements.

(9) Mo (molybdenum): 0.2–1.0%

Mo has functions which are similar to those of W. However, by the addition of Mo alone, less effects are obtainable than where W is used alone. Accordingly, to have synergistic effects with W, the amount of Mo should be 0.2–1.0%. The preferred amount of Mo is 0.3–0.8%.

(10) Co (cobalt): 20.0% or less

Co is an element effective like Ni for stabilizing an austenite structure, thereby improving the high-temperature strength. Particularly when added together with Ni, the austenite structure is further stabilized. Also, in an operating atmosphere containing S, Ni tends to form a low-melting point sulfide. Accordingly, Co is more preferable. When the total amount of Ni+Co exceeds 30%, no further improvement is achieved, leading to an economical disadvantage. Accordingly, the total amount of Ni+Co should be 8.0–30.0%. However, Co exceeding 20.0% would provide no further improvement, leading to an economical disadvantage. Accordingly, the amount of Co should be 8.0–20.0%. The preferred amount of Co is 3.0–15.0%.

Such heat-resistant, austenitic cast steel of the present invention is particularly suitable for thin parts such as exhaust equipment members, exhaust manifolds, turbine housings, etc. for automobile engines which should be durable without suffering from cracks under heating-cooling cycles.

The present invention will be explained in detail by way of the following Examples.

EXAMPLES 1–19, and COMPARATIVE EXAMPLES 1–5

With respect to heat-resistant, austenitic cast steels having compositions shown in Table 1, Y-block test pieces (No. B according to JIS) were prepared by casting. Incidentally, the casting was conducted by melting the steel in the atmosphere in a 100-kg high-frequency furnace, removing the resulting melt from the furnace while it was at a temperature of 1550° C. or higher, and pouring it into a mold at about 1500° C. or higher. The heat-resistant, austenitic cast steels of the present invention (Examples 1–19) showed good fluidity during casting, thereby generating no cast defects such as voids.

TABLE 1

| | Additive Component (Weight %) | | | | |
|---|---|---|---|---|---|
| | C | Si | Mn | Ni | Cr |
| Example No. | | | | | |
| 1 | 0.19 | 1.04 | 0.51 | 9.78 | 20.63 |
| 2 | 0.29 | 0.96 | 0.55 | 10.14 | 16.50 |
| 3 | 0.28 | 1.05 | 0.49 | 15.09 | 28.20 |
| 4 | 0.30 | 1.01 | 0.59 | 15.05 | 25.31 |
| 5 | 0.29 | 0.99 | 0.47 | 18.44 | 21.47 |
| 6 | 0.29 | 1.02 | 0.47 | 9.86 | 19.33 |
| 7 | 0.31 | 1.01 | 0.51 | 9.79 | 18.82 |
| 8 | 0.30 | 0.87 | 0.54 | 10.80 | 19.78 |
| 9 | 0.31 | 1.05 | 0.48 | 10.43 | 19.85 |
| 10 | 0.29 | 1.03 | 0.52 | 9.97 | 20.02 |
| 11 | 0.49 | 1.00 | 0.49 | 9.97 | 19.58 |
| 12 | 0.28 | 1.06 | 0.49 | 9.74 | 19.28 |
| 13 | 0.48 | 1.06 | 0.50 | 9.93 | 20.28 |
| 14 | 0.41 | 1.00 | 0.50 | 9.96 | 20.21 |
| 15 | 0.43 | 0.97 | 0.51 | 9.05 | 20.52 |
| 16 | 0.38 | 0.92 | 0.46 | 9.26 | 19.56 |
| 17 | 0.37 | 0.97 | 0.49 | 10.09 | 19.26 |
| 18 | 0.32 | 0.98 | 0.53 | 10.70 | 20.62 |
| 19 | 0.27 | 0.96 | 0.49 | 9.89 | 20.17 |
| Comparative Example No. | | | | | |
| 1 | 3.33 | 4.04 | 0.35 | — | — |
| 2 | 0.28 | 1.05 | 0.44 | — | 17.9 |
| 3 | 2.77 | 2.12 | 0.88 | 21.10 | 2.44 |
| 4 | 1.89 | 5.32 | 0.41 | 34.50 | 2.35 |
| 5 | 0.21 | 1.24 | 0.50 | 9.1 | 18.8 |

| | W | Nb | B | Mo | Co |
|---|---|---|---|---|---|
| Example No. | | | | | |
| 1 | 2.02 | 0.28 | 0.002 | — | — |
| 2 | 2.50 | 0.32 | 0.003 | — | — |
| 3 | 3.01 | 0.31 | 0.004 | — | — |
| 4 | 3.07 | 0.29 | 0.004 | — | — |
| 5 | 3.02 | 0.32 | 0.008 | — | — |
| 6 | 2.93 | 0.28 | 0.004 | — | — |
| 7 | 2.89 | 0.48 | 0.003 | — | — |
| 8 | 2.02 | 0.31 | 0.003 | 0.49 | — |
| 9 | 2.03 | 0.52 | 0.004 | 0.52 | — |
| 10 | 2.86 | 0.94 | 0.003 | — | — |
| 11 | 3.09 | 0.98 | 0.003 | — | — |
| 12 | 4.88 | 0.48 | 0.003 | — | — |
| 13 | 5.03 | 0.48 | 0.003 | — | — |
| 14 | 3.05 | 0.50 | 0.003 | — | — |
| 15 | 3.02 | 0.44 | 0.003 | — | 4.50 |
| 16 | 2.04 | 0.42 | 0.004 | 0.55 | 9.31 |
| 17 | 2.94 | 0.47 | 0.004 | — | 18.74 |
| 18 | 3.00 | 0.51 | 0.004 | — | 10.39 |
| 19 | 2.89 | 0.47 | 0.003 | — | 17.66 |
| Comparative Example No. | | | | | |
| 1 | — | — | — | 0.62 | — |
| 2 | — | — | — | — | — |
| 3 | — | — | — | — | — |
| 4 | — | — | — | — | — |
| 5 | — | — | — | — | — |

Next, test pieces (Y-blocks) of Examples 1–19 and Comparative Examples 3, 4 and 5 were subjected to a heat treatment comprising heating them at 1000° C. for 2 hours and cooling them in the air. On the other hand, the test piece of Comparative Example 1 was used in the as-cast state for the tests. The test piece of Comparative Example 2 was subjected to a heat treatment comprising heating it at 800° C. for 2 hours in a furnace and cooling it in the air.

Incidentally, the test pieces of Comparative Examples 1–5 in Table 1 are those used for heat-resistant parts such as turbo charger housings, exhaust manifolds, etc. for automobiles. The test piece of Comparative Example 1 is high-Si spheroidal graphite cast iron. The test piece of Comparative Example 2 is a CB-30 according to the ACI (Alloy Casting Institute) standards. The test pieces of Comparative Examples 3 and 4 are D2 and D5S of NI-RESIST cast iron. The test piece of Comparative Example 5 is a conventional heat-resistant, austenite cast steel SCH-12 according to JIS.

Next, with respect to each cast test piece, the following evaluation tests were conducted.

(1) Tensile Test at a Room Temperature

Conducted on a rod test piece having a gauge length of 50 mm and a gauge diameter of 14 mm (No. 4 test piece according to JIS).

(2) Tensile Test at a High Temperature

Conducted on a flanged test piece having a gauge length of 50 mm and a gauge diameter of 10 mm at temperatures of 900° C. and 1050° C., respectively.

(3) Thermal Fatigue Test

Using a rod test piece having a gauge length of 20 mm and a gauge diameter of 10 mm, a heating-cooling cycle was repeated to cause thermal fatigue failure in a state where expansion and shrinkage due to heating and cooling were completely restrained mechanically, under the following conditions:

Lowest temperature: 150° C.
Highest temperature: 1000° C.
Each cycle: 12 minutes.

Incidentally, an electric-hydraulic servo-type thermal fatigue test machine was used for the test.

(4) Oxidation Test

A rod test piece having a diameter of 10 mm and a length of 20 mm was kept in air at 1000° C. for 200 hours, and its oxide scale was removed by a shot blasting treatment to measure the weight variation per unit surface area. By calculating oxidation weight loss (mg/cm$^2$) after the oxidation test, the oxidation resistance was evaluated.

The results of the tensile test at room temperature are shown in Table 2, the results of the tensile test at high temperature are shown in Table 3, and the thermal fatigue test and the oxidation test results are shown in Table 4.

TABLE 2

| | at Room Temperature | | | |
|---|---|---|---|---|
| | 0.2% Offset Yield Strength (MPa) | Tensile Strength (MPa) | Elongation (%) | Hardness ($H_B$) |
| Example No. | | | | |
| 1 | 250 | 595 | 26 | 170 |
| 2 | 300 | 555 | 11 | 179 |
| 3 | 280 | 510 | 7 | 201 |
| 4 | 265 | 555 | 13 | 179 |
| 5 | 275 | 560 | 12 | 187 |
| 6 | 275 | 590 | 19 | 179 |
| 7 | 300 | 565 | 11 | 197 |
| 8 | 285 | 540 | 12 | 183 |
| 9 | 300 | 555 | 11 | 192 |
| 10 | 255 | 565 | 14 | 179 |
| 11 | 325 | 540 | 4 | 223 |
| 12 | 280 | 600 | 14 | 197 |
| 13 | 325 | 525 | 4 | 217 |
| 14 | 335 | 540 | 4 | 217 |
| 15 | 315 | 540 | 10 | 201 |
| 16 | 290 | 540 | 6 | 217 |
| 17 | 320 | 545 | 5 | 223 |
| 18 | 305 | 540 | 7 | 201 |
| 19 | 305 | 535 | 9 | 201 |
| Comparative Example No. | | | | |
| 1 | 510 | 640 | 11 | 217 |
| 2 | 540 | 760 | 4 | 240 |
| 3 | 190 | 455 | 16 | 179 |
| 4 | 255 | 485 | 9 | 163 |
| 5 | 250 | 560 | 20 | 170 |

TABLE 4

| | Thermal Fatigue Life (Cycle) | Weight Loss by Oxidation (mg/mm$^2$) |
|---|---|---|
| Example No. | | |
| 1 | 88 | 25 |
| 2 | 92 | 30 |
| 3 | 115 | 15 |
| 4 | 105 | 18 |
| 5 | 102 | 18 |
| 6 | 120 | 35 |
| 7 | 135 | 40 |
| 8 | 105 | 50 |
| 9 | 110 | 50 |
| 10 | 152 | 26 |
| 11 | 145 | 35 |
| 12 | 160 | 30 |
| 13 | 175 | 35 |
| 14 | 185 | 18 |
| 15 | 180 | 23 |
| 16 | 150 | 28 |
| 17 | 195 | 15 |
| 18 | 165 | 20 |
| 19 | 177 | 22 |
| Comparative Example No. | | |
| 1 | — | — |
| 2 | 10 | 105 |
| 3 | 56 | 765 |
| 4 | 85 | 55 |
| 5 | 80 | 85 |

As is clear from Tables 2–4, the test pieces of Examples 1–19 are comparable to or even superior to those of Comparative Examples 3 and 4 (NI-RESIST D2 and D5S) with respect to the properties at room temperature, and particularly superior with respect to the high-temperature strength of 900° C. or higher. In addition, the test pieces of Examples 1–19 are superior to that of Comparative Example 5 (SCH12) with respect to the high-temperature strength at 1000° C. Also, as shown in Table 2, the test pieces of Examples 1–19 show relatively low hardness ($H_B$) of 170–223. This means that they are excellent in machinability.

TABLE 3

| | at 900° C. | | | at 1050° C. | | |
|---|---|---|---|---|---|---|
| | 0.2% Offset Yield Strength (MPa) | Tensile Strength (MPa) | Elongation (%) | 0.2% Offset Yield Strength (MPa) | Tensile Strength (MPa) | Elongation (%) |
| Example No. | | | | | | |
| 1 | 65 | 120 | 36 | 33 | 59 | 38 |
| 2 | 66 | 129 | 32 | 36 | 65 | 36 |
| 3 | 84 | 172 | 27 | 35 | 77 | 27 |
| 4 | 80 | 153 | 42 | 42 | 75 | 37 |
| 5 | 84 | 151 | 28 | 44 | 77 | 33 |
| 6 | 82 | 145 | 34 | 37 | 65 | 38 |
| 7 | 88 | 155 | 25 | 46 | 75 | 34 |
| 8 | 81 | 140 | 34 | 40 | 69 | 42 |
| 9 | 85 | 150 | 31 | 43 | 72 | 36 |
| 10 | 77 | 139 | 29 | 37 | 68 | 34 |
| 11 | 97 | 173 | 22 | 62 | 101 | 30 |
| 12 | 77 | 146 | 32 | 40 | 74 | 34 |
| 13 | 94 | 177 | 28 | 50 | 97 | 30 |
| 14 | 103 | 206 | 32 | 60 | 96 | 27 |
| 15 | 90 | 150 | 38 | 53 | 88 | 40 |
| 16 | 97 | 167 | 27 | 56 | 91 | 30 |
| 17 | 108 | 186 | 31 | 54 | 89 | 35 |
| 18 | 97 | 166 | 28 | 46 | 77 | 30 |
| 19 | 98 | 166 | 36 | 49 | 82 | 38 |
| Comparative Example No. | | | | | | |
| 1 | 20 | 40 | 33 | — | — | — |
| 2 | 25 | 42 | 58 | 15 | 28 | 103 |
| 3 | 41 | 64 | 27 | 22 | 36 | 36 |
| 4 | 48 | 73 | 29 | 25 | 45 | 22 |
| 5 | 65 | 128 | 93 | 30 | 50 | 100 |

Next, an exhaust manifold (thickness: 2.5–3.4 mm) and a turbine housing (thickness: 2.7–4.1 mm) were produced by casting the heat-resistant, austenitic cast steel of Examples 5, 15 and 19. All of the resulting heat-resistant cast steel parts were free from casting defects. These cast parts were machined to evaluate their cuttability. As a result, no problem was found in any cast parts.

Next, the exhaust manifold and the turbine housing were mounted to a high-performance, straight-type, four-cylinder, 2000-cc gasoline engine (test machine) to conduct a durability test. The test was conducted by repeating 500 heating-cooling (Go-Stop) cycles each consisting of a continuous full-load operation at 6000 rpm (14 minutes), idling (1 minute), complete stop (14 minutes) and idling (1 minute) in this order. The exhaust gas temperature under a full load was 1050° C. at the inlet of the turbo charger housing. Under this condition, the highest surface temperature of the exhaust manifold was about 980° C. in a pipe-gathering portion thereof, and the highest surface temperature of the turbo charger housing was about 1020° C. in a waist gate portion thereof. As a result of the evaluation test, no gas leaks or thermal cracking were observed. It was thus confirmed that the exhaust manifold and the turbine housing made of the heat-resistant, austenitic cast steel of the present invention had excellent durability and reliability.

As described above in detail, the heat-resistant austenitic cast steel of the present invention has excellent high-temperature strength, particularly at 900° C. or higher, without deteriorating its room-temperature ductility, and it can be produced at a low cost. Such heat-resistant, austenitic cast steel of the present invention is particularly suitable for exhaust equipment members for engines, etc. such as exhaust manifolds, turbine housings, etc. The exhaust equipment members made of such heat-resistant, austenite cast steel according to the present invention have excellent high-temperature strength, thereby showing extremely good durability.

What is claimed is:

1. An austenitic cast steel having a composition consisting essentially, by weight, of:

C: 0.20–0.60%,
Si: 2.0% or less,
Mn: 1.0% or less,
Ni: 8.0–20.0%,
Cr: 15.0–30.0%,
W: 2.0–6.0%,
Nb: 0.2–1.0%,
B: 0.001–0.01%,
the balance being Fe and inevitable impurities, said steel having a high resistance to thermal fatigue.

2. An austenitic cast steel having a composition consisting essentially, by weight, of:

C: 0.20–0.60%,
Si: 2.0% or less,
Mn: 1.0% or less,
Ni: 8.0–20.0%,
Cr: 15.0–30.0%,
W: 2.0–6.0%,
Nb: 0.2–1.0%,
B: 0.001–0.01%,
Mo: 0.2–1.0%, and
the balance being Fe and inevitable impurities, said steel having a high resistance to thermal fatigue.

3. An austenitic cast steel having a composition consisting essentially, by weight, of:

C: 0.20–0.60%,
Si: 2.0% or less,
Mn: 1.0% or less,
Ni: 8.0–20.0%,
Cr: 15.0–30.0%,
W: 2.0–6.0%,
Nb: 0.2–1.0%,
B: 0.001–0.01%,
Co: 20.0% or less, and
the balance being Fe and inevitable impurities, said steel having a high resistance to thermal fatigue.

4. An austenitic cast steel having a composition consisting essentially, by weight, of:

C: 0.20–0.60%,
Si: 2.0% or less,
Mn: 1.0% or less,
Ni: 8.0–20.0%,
Cr: 15.0–30.0%,
W: 2.0–6.0%
Nb: 0.2–1.0%,
B: 0.001–0.01%,
Mo: 0.2–1.0%,
Co: 20.0% or less, and
the balance being Fe and inevitable impurities, said steel having a high resistance to thermal fatigue.

5. An exhaust equipment member made of a austenitic cast steel according to claim 1.

6. An exhaust equipment member made of a austenitic cast steel according to claim 2.

7. An exhaust equipment member made of a austenitic cast steel according to claim 3.

8. An exhaust equipment member made of a austenitic cast steel according to claim 4.

9. The exhaust equipment member according to claim 5, wherein said exhaust equipment member is an exhaust manifold.

10. The exhaust equipment member according to claim 6, wherein said exhaust equipment member is an exhaust manifold.

11. The exhaust equipment member according to claim 7, wherein said exhaust equipment member is an exhaust manifold.

12. The exhaust equipment member according to claim 8, wherein said exhaust equipment member is an exhaust manifold.

13. The exhaust equipment member according to claim 5, wherein said exhaust equipment member is a turbine housing.

14. The exhaust equipment member according to claim 6, wherein said exhaust equipment member is a turbine housing.

15. The exhaust equipment member according to claim 7, wherein said exhaust equipment member is a turbine housing.

16. The exhaust equipment member according to claim 8, wherein said exhaust equipment member is a turbine housing.

17. An austenitic cast steel having a composition consisting essentially, by weight, of:

C: 0.20–0.60%,
Si: 0.87–2.0%,
Mn: 1.0% or less,
Ni: 8.0–10.8%,
Cr: 15.0–30.0%,
W: 2.86–6.0%,
Nb: 0.2–1.0%,
B: 0.001–0.01%,
the balance being Fe and inevitable impurities, said steel having a high resistance to thermal fatigue.

18. An austenitic cast steel having a composition consisting essentially, by weight, of:
C: 0.20–0.60%,
Si: 0.87–2.0%,
Mn: 1.0% or less,
Ni: 8.0–20.0%,
Cr: 15.0–30.0%,
W: 2.0–6.0%,
Nb: 0.2–1.0%,
B: 0.001–0.01%,
Mo: 0.2–1.0%, and
the balance being Fe and inevitable impurities, said steel having a high resistance to thermal fatigue.

19. An austenitic cast steel having a composition consisting essentially, by weight, of:
C: 0.20–0.60%,
Si: 0.87–2.0%,
Mn: 1.0% or less,
Ni: 8.0–10.8%,
Cr: 15.0–30.0%,
W: 2.02–6.0%,
Nb: 0.2–1.0%,
B: 0.001–0.01%,
Co: 20.0% or less, and
the balance being Fe and inevitable impurities, said steel having a high resistance to thermal fatigue.

20. An austenitic cast steel having a composition consisting essentially, by weight, of:
C: 0.20–0.60%,
Si: 0.87–2.0%,
Mn: 1.0% or less,
Ni: 8.0–10.8%,
Cr: 15.0–30.0%,
W: 2.02–6.0%,
Nb: 0.2–1.0%,
B: 0.001–0.01%,
Mo: 0.2–1.0%, and
the balance being Fe and inevitable impurities, said steel having a high resistance to thermal fatigue.

21. An austenitic cast steel having a composition consisting essentially, by weight, of:
C: 0.20–0.60%,
Si: 0.87–2.0%,
Mn: 1.0% or less,
Ni: 8.0–10.8%,
Cr: 15.0–30.0%,
W: 2.02–6.0%,
Nb: 0.2–1.0%,
B: 0.001–0.01%,
Mo: 0.2–1.0%,
Co: 20.0% or less, and
the balance being Fe and inevitable impurities, said steel having a high resistance to thermal fatigue.

22. The exhaust member according to claim 9, wherein said exhaust manifold is an exhaust manifold for automotive engines.

23. The exhaust member according to claim 10, wherein said exhaust manifold is an exhaust manifold for automotive engines.

24. The exhaust member according to claim 11, wherein said exhaust manifold is an exhaust manifold for automotive engines.

25. The exhaust member according to claim 12, wherein said exhaust manifold is an exhaust manifold for automotive engines.

26. The exhaust equipment member according to claim 13, wherein said turbine housing is a turbine housing for automotive engines.

27. The exhaust equipment member according to claim 14, wherein said turbine housing is a turbine housing for automotive engines.

28. The exhaust equipment member according to claim 15, wherein said turbine housing is a turbine housing for automotive engines.

29. The exhaust equipment member according to claim 16, wherein said turbine housing is a turbine housing for automotive engines.

* * * * *

UNITED STATES PATENT AND TRADEMARK OFFICE

CERTIFICATE OF CORRECTION

PATENT NO. : 5,194,220
DATED : March 16, 1993
INVENTOR(S) : Takahashi, et. al.

It is certified that error appears in the above-indentified patent and that said Letters Patent is hereby corrected as shown below:

On the Title page, item [57] Abstract, col. 2, line 2, after "weight" insert a comma --,--.
Claim 4, col. 10, line 18, after "W:2.0-6.0%" insert a comma --,--.
Claim 5, col. 10, line 25, change "a" to --an--.
Claim 6, col. 10, line 27, change "a" to --an--.
Claim 7, col. 10, line 29, change "a" to --an--.
Claim 8, col. 10, line 31, change "a" to --an--.

Signed and Sealed this

Fifteenth Day of March, 1994

*Attest:*

Bruce Lehman

BRUCE LEHMAN

*Attesting Officer*

*Commissioner of Patents and Trademarks*